US008021182B2

(12) United States Patent
Kuo

(10) Patent No.: US 8,021,182 B2
(45) Date of Patent: Sep. 20, 2011

(54) ELECTRICAL CONNECTOR ASSEMBLY

(75) Inventor: Chih Cheng Kuo, Taipei (TW)

(73) Assignee: Tyco Electronics Holdings (Bermuda) No. 7 Ltd., Pembroke (BM)

( * ) Notice: Subject to any disclaimer, the term of this patent is extended or adjusted under 35 U.S.C. 154(b) by 0 days.

(21) Appl. No.: 12/830,046

(22) Filed: Jul. 2, 2010

(65) Prior Publication Data

US 2011/0003495 A1 Jan. 6, 2011

(30) Foreign Application Priority Data

Jul. 3, 2009 (TW) ..... 98212072 U

(51) Int. Cl.
*H01R 13/627* (2006.01)

(52) U.S. Cl. ..... 439/352

(58) Field of Classification Search ..... 439/352, 439/155, 67, 676, 752, 353, 357–358
See application file for complete search history.

(56) References Cited

U.S. PATENT DOCUMENTS 3,522,600 A * 8/1970 Amis, Jr. et al. ..... 340/815.48
4,655,527 A * 4/1987 Vandame ..... 439/350
5,015,199 A * 5/1991 Hirano et al. ..... 439/353
5,839,912 A * 11/1998 Schekalla et al. ..... 439/157
5,971,815 A * 10/1999 Polgar et al. ..... 439/752
6,655,979 B1 * 12/2003 Lee ..... 439/357
7,163,413 B2 1/2007 Murayama
2002/0137397 A1 * 9/2002 Little ..... 439/686
2005/0118880 A1 * 6/2005 Reichle ..... 439/676
2006/0292900 A1 * 12/2006 Pabst et al. ..... 439/67

FOREIGN PATENT DOCUMENTS

TW 424977 3/2001

* cited by examiner

*Primary Examiner* — Jean F Duverne
(74) *Attorney, Agent, or Firm* — Barley Snyder LLC

(57) ABSTRACT

An electrical connector assembly has a socket, a plug, a sliding slot, and a fastener. The socket includes having a slot and a first latch disposed at one side of the slot. The plug is insertable into the slot of the socket, and is provided with a second latch corresponding to the first latch of the socket. The sliding slot is disposed on the second latch corresponding to the first latch of the socket. The fastener is positioned on the second latch of the plug. When the plug is inserted into the socket, the fastener can be moved to connect the first and second latches to fasten together the plug and socket. Furthermore, the fastener can be moved along the sliding slot in a direction away from the first latch to unfasten the plug and the socket.

22 Claims, 12 Drawing Sheets

ELECTRICAL CONNECTOR ASSEMBLY

CROSS-REFERENCE TO RELATED APPLICATIONS

This application claims priority under 35 U.S.C. §119 to Taiwanese Patent Application No. 98212072, filed Jul. 3, 2009.

FIELD OF THE INVENTION

The present invention relates to an electrical connector assembly, and more particularly, to an electrical connector assembly having a fastener for fastening or unfastening a plug and a socket.

BACKGROUND

Electronic products have been developed in response to an increasing demand for electronic components with improved functionality as well as increased stability, which meets demands of higher electrical performance and an increasingly complex usage environment. A connector having improved stability is an important factor in determining the functionality of the electronic components, since the connector functions to connect electronic components and transmit signals there between. Moreover, the convenience with regard to assembly is crucial, as well as durability.

FIG. 4 is a block diagram of a known electrical connector 20 having a socket 21 with a slot (not shown), a plug 22 inserted into the slot of the socket 21 and a pulling mechanism 23 disposed on the plug 22. By pulling the pulling mechanism 23, the plug 22 can be detached from the socket 21.

The known electrical connector 20 is not provided with a protective mechanism or any component for securing the connection between the socket 21 and the plug 22, and as a result, an external force or other factors may contribute to the separation of the socket 21 and the plug 22. Therefore, a need exists in order to overcome the aforementioned drawbacks of the prior art electrical connector 20.

SUMMARY

An object of the present invention among others, is to provide an electrical connector assembly in which the socket and the plug are provided with a first latch and a second latch, respectively, and a fastener is configured to move alongside the first and second latches in order to fasten together the plug and the socket or to unfasten the plug and the socket for separation.

The electrical connector assembly includes a socket having a slot and a first latch disposed at one side of the slot, a plug inserted into the slot of the socket, the plug being provided with a second latch corresponding to the first latch of the socket, a sliding slot being disposed on the second latch corresponding to the first latch of the socket, and a fastener disposed on the second latch of the plug, wherein when the plug is inserted into the socket, the fastener can be moved to connect the first and second latches to fasten together the plug and socket. The fastener can be moved along the sliding slot in a direction away from the first latch to unfasten the plug and the socket.

DETAILED DESCRIPTION OF THE EMBODIMENT(S)

While the present invention will be described in detail by way of embodiments of the present invention with reference to the accompanying drawings, it is to be understood that the skilled person in the art can make various modifications to the present invention and achieve the same effect as disclosed herein. Hence, it is to be understood that the following description of the present invention is a broad interpretation to the skilled person in the art, and the present invention is not limited thereto.

Figure 1A:
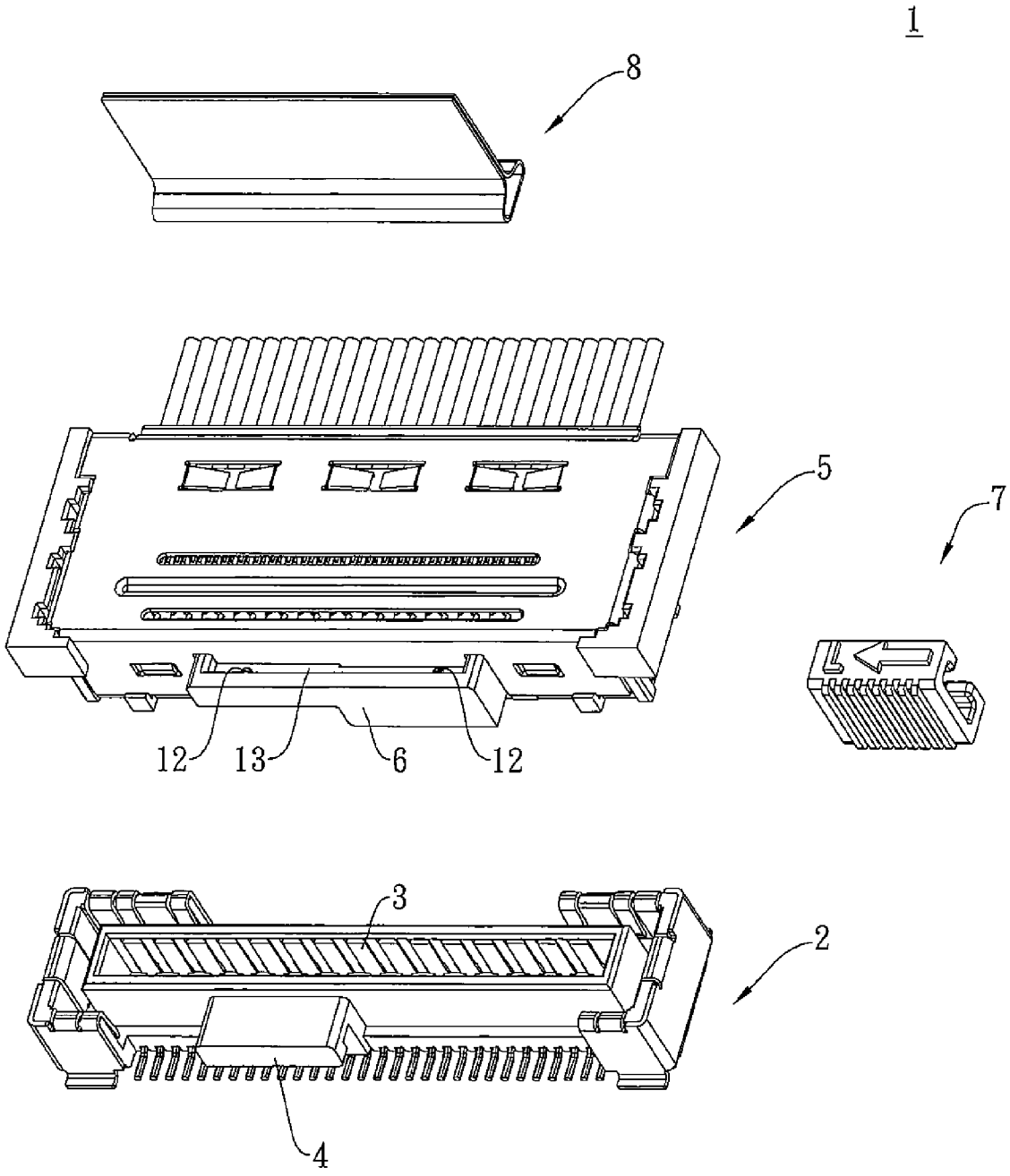
FIG. 1A is an exploded view of an electrical connector assembly according to the invention.
Figure 1B:
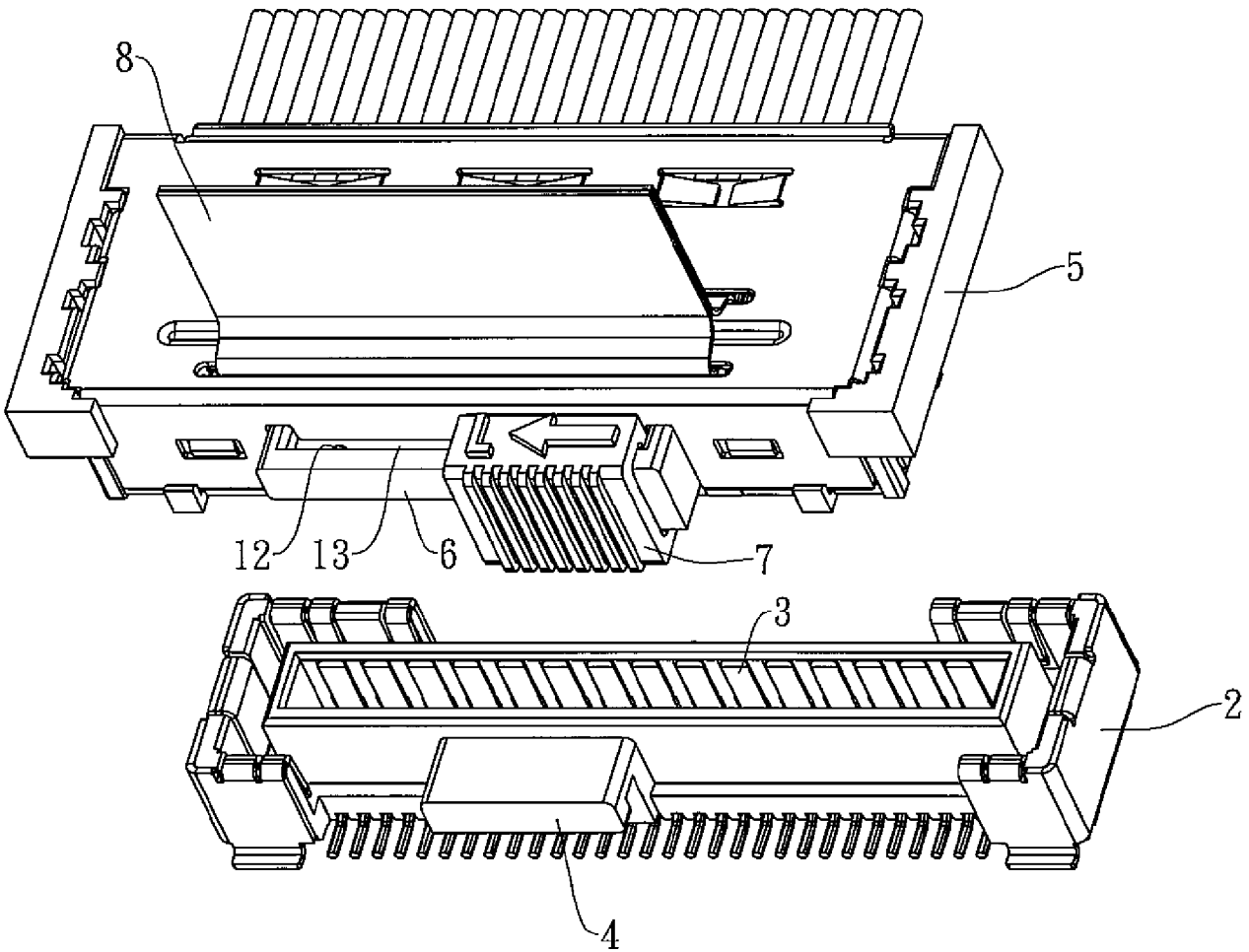
FIG. 1B is another exploded view of the electrical connector assembly according to the invention.
Figure 1C:
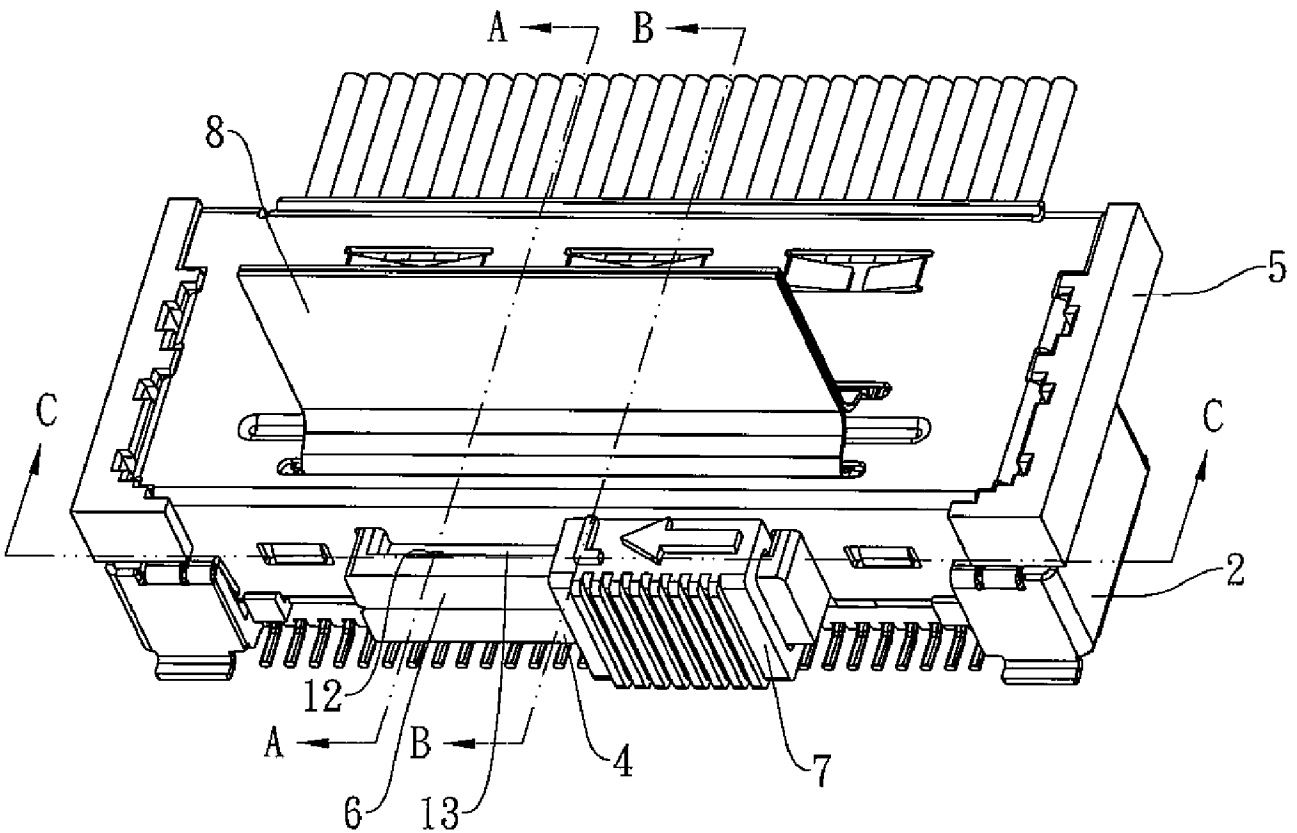
FIG. 1C is a perspective view of the electrical connector assembly according to the invention.

With reference to FIGS. 1A, 1B, and 1C, an electrical connector assembly 1 is shown having a socket 2, a plug 5, a fastener 7, and a pulling mechanism 8. The socket 2 includes a slot 3 and a first latch 4 disposed at one side of the slot 3, with the plug 5 inserted into the slot 3. The plug 5 is provided with a second latch 6 corresponding to the first latch 4 of the socket 2. The fastener 7 is connected to the second latch 6 of the plug 5, while the pulling mechanism 8 is disposed on the plug 5. The top of the second latch 6 of the plug 5 is provided with a sliding slot 13 along which the fastener 7 may be moved.

Figure 1D:
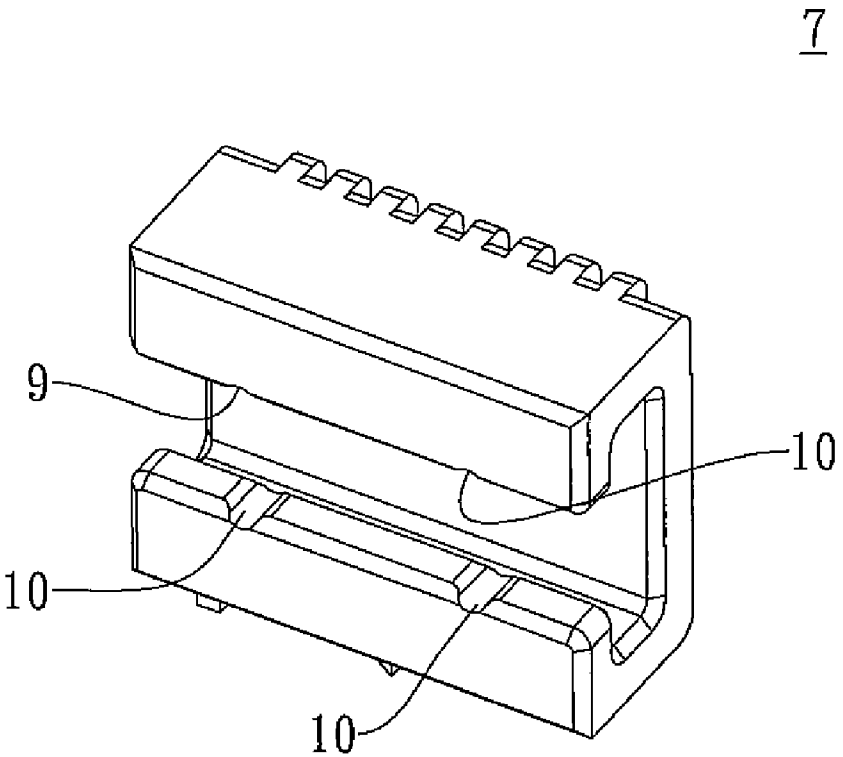
FIG. 1D is a perspective view of a fastener according to the invention.

With reference to FIG. 1D, the fastener 7 is shown, with an inner side of the fastener 7 being provided with a first receiving piece 9 and three second receiving pieces 10. Furthermore, the top surface of the fastener 7 is provided with a symbol "L←" to indicate that the socket 2 and the plug 5 can be fastened together by moving the fastener 7 in the direction shown by the arrow, as will be described in greater detail hereinafter.

Figure 2A:
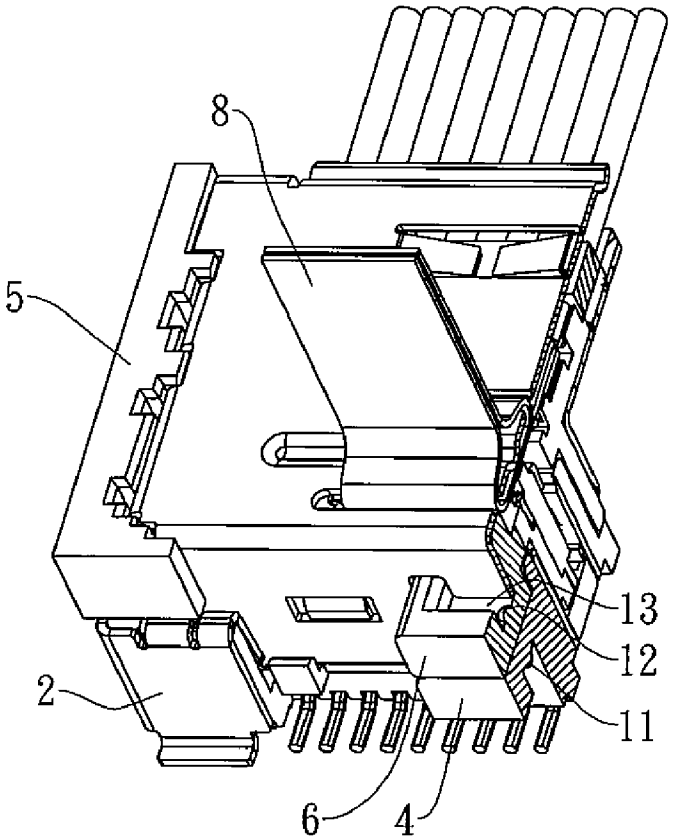
FIG. 2A is a cross-sectional view of the electrical connector assembly along line A-A of FIG. 1C.
Figure 2B:
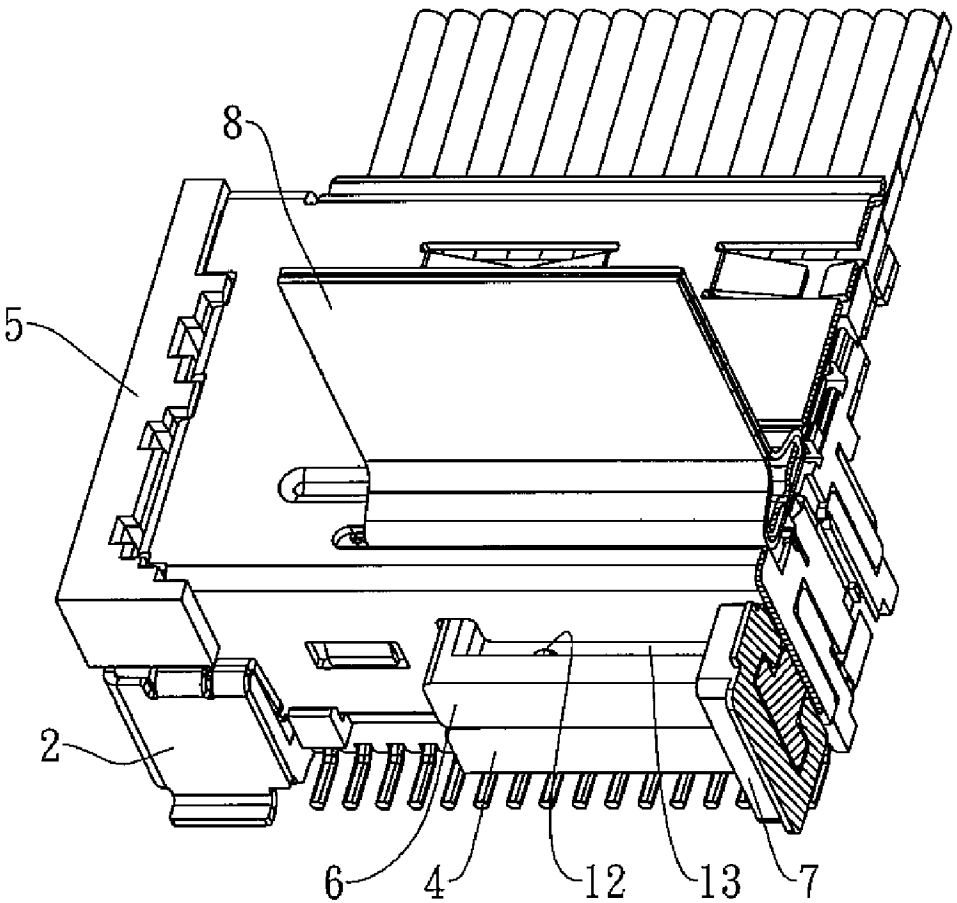
FIG. 2B is a cross-sectional view of the electrical connector assembly along line B-B of FIG. 1C.
Figure 2C:
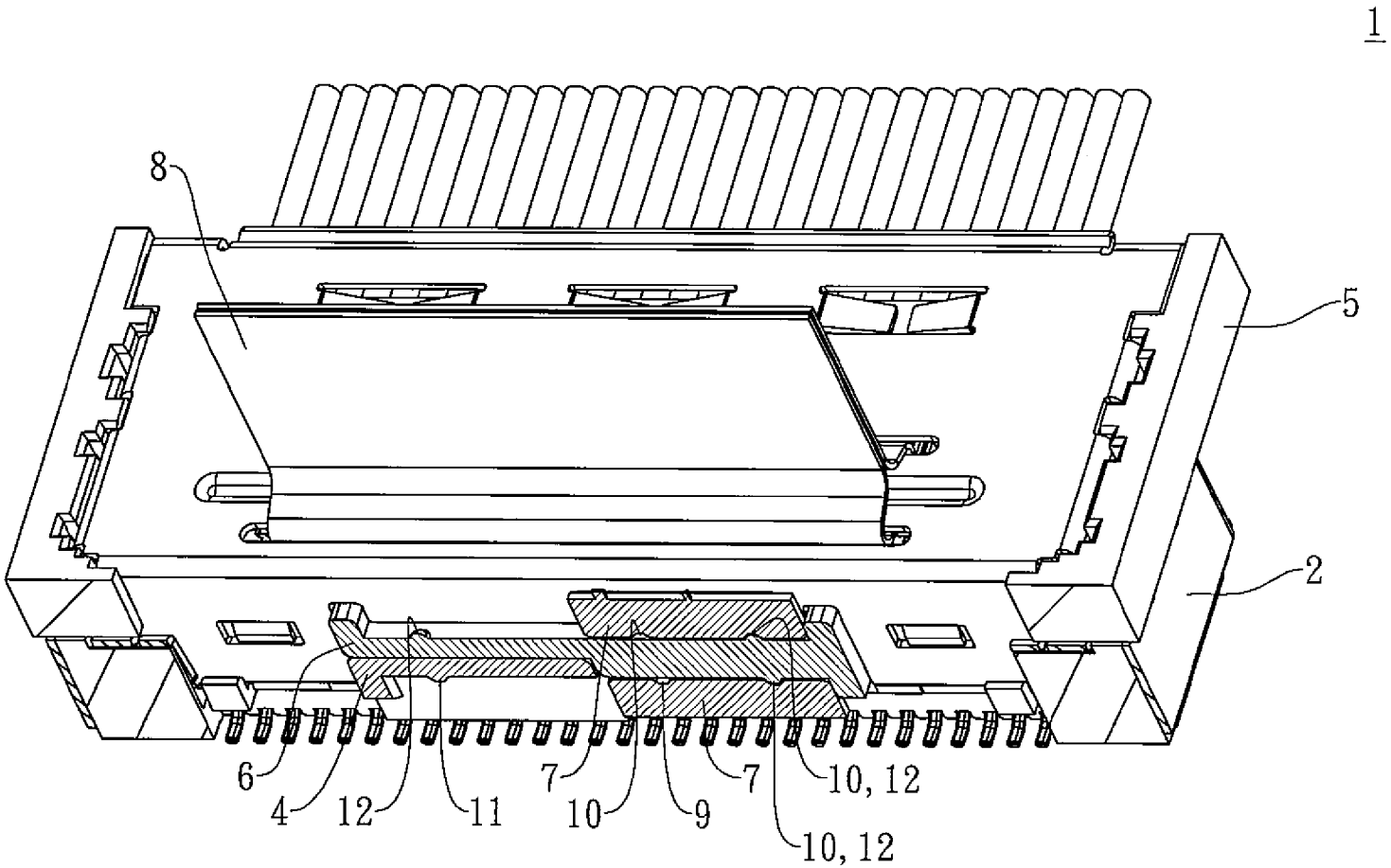
FIG. 2C is a cross-sectional view of the electrical connector assembly along line C-C of FIG. 1C.

Referring to FIG. 2C, the bottom of the first latch 4 is provided with a first projection 11. The top and bottom of the second latch 6 are provided with several second projections 12. In the embodiment shown, two second projections 12 are positioned on top of the second latch 6, while one second projection 12 is positioned on the bottom of the second latch 6.

In FIG. 2C, the fastener 7 is positioned along a right side of the electrical connector assembly 1. In the embodiment shown in FIG. 2C, the second receiving piece 10 at the right side of the upper portion of the fastener 7 receives the second projection 12 along the right side of the top of the second latch 6, while the second receiving piece 10 at the right side of the lower portion of the fastener 7 receives the second projection 12 at the right side of the bottom of the second latch 6. Accordingly, the fastener 7 is shown in an "unfastened position".

Figure 3A:
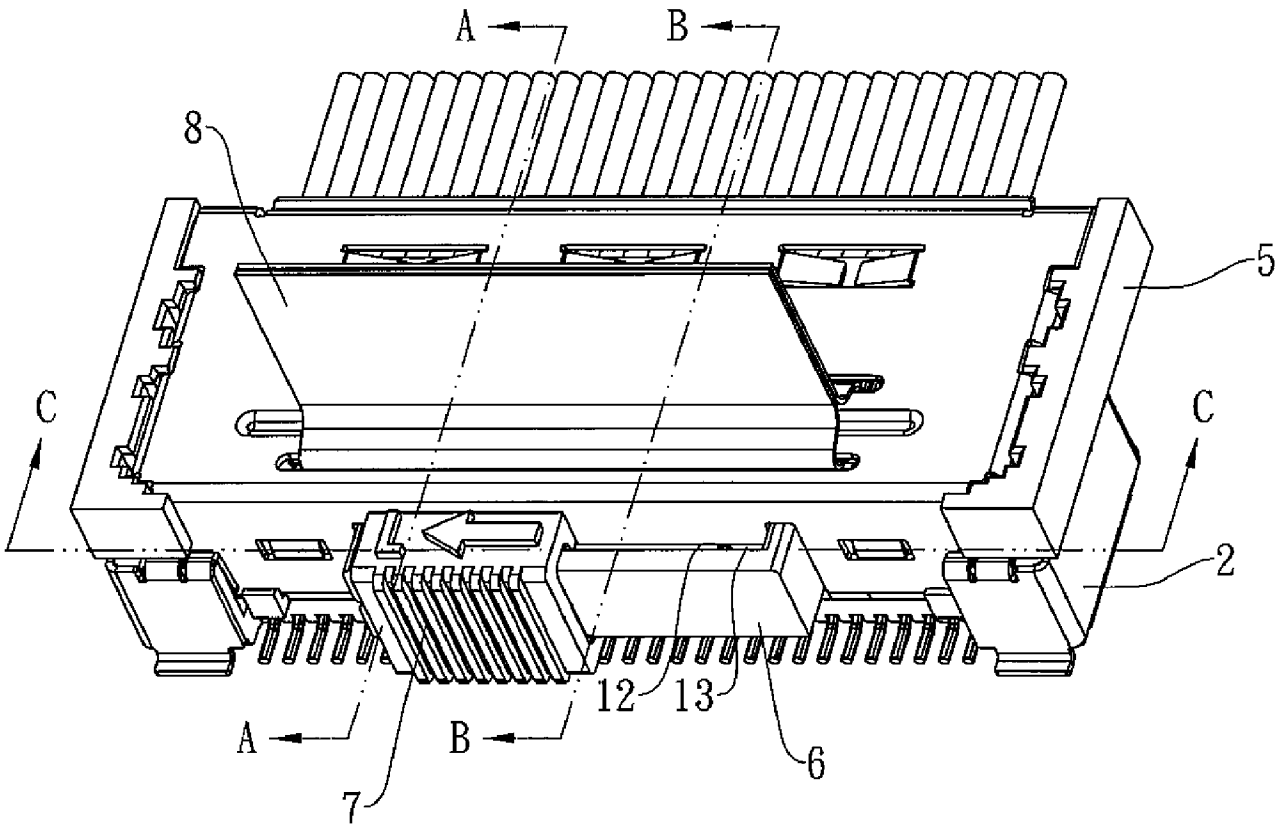
FIG. 3A is another perspective view of the electrical connector assembly according to the invention.
Figure 3B:
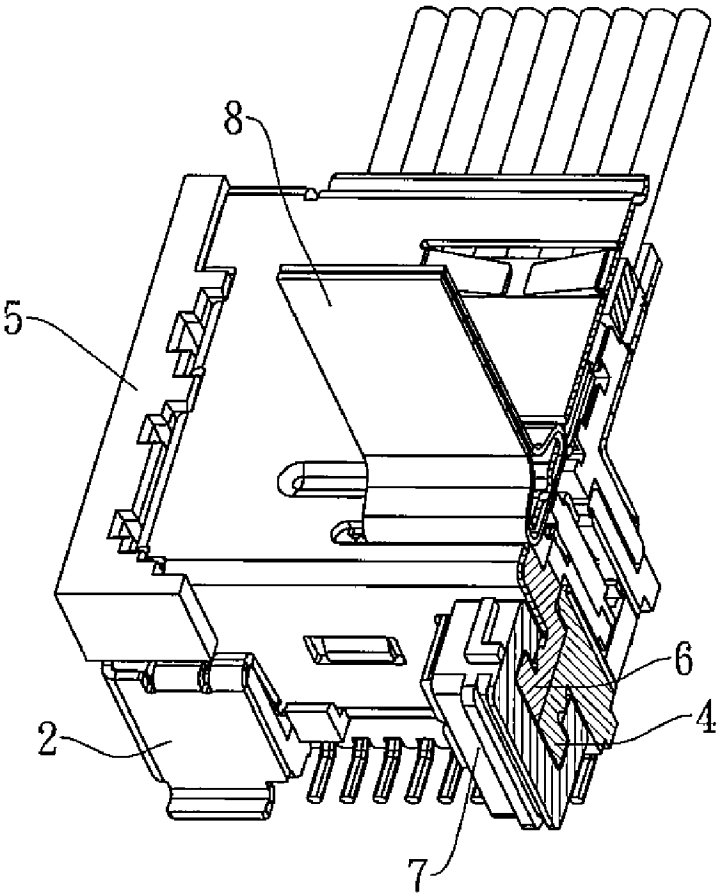
FIG. 3B is a cross-sectional view of the electrical connector assembly along line A-A of FIG. 3A.
Figure 3C:
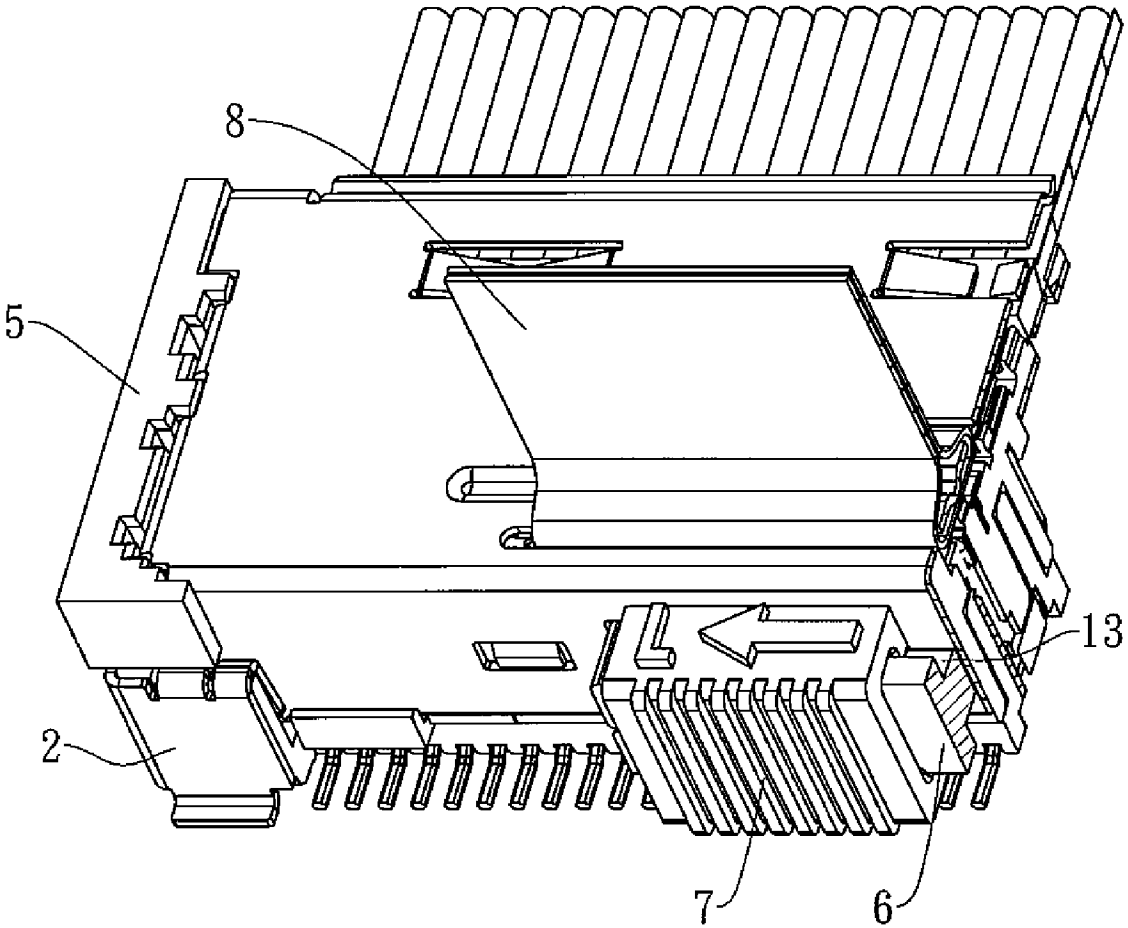
FIG. 3C is a cross-sectional view of the electrical connector assembly along line B-B of FIG. 3A.
Figure 3D:
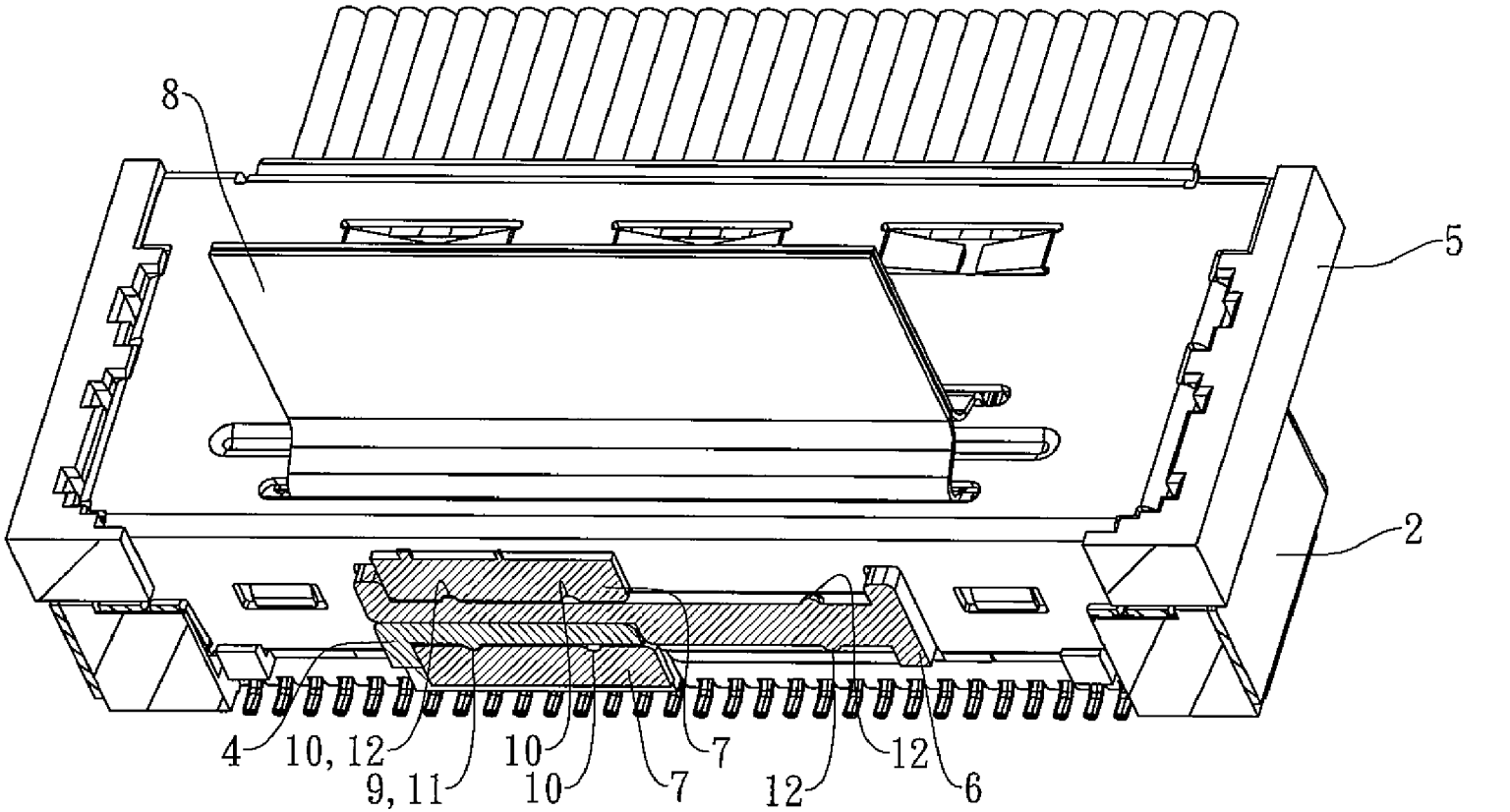
FIG. 3D is a cross-sectional view of the electrical connector assembly along line C-C of FIG. 3A.
Figure 4:
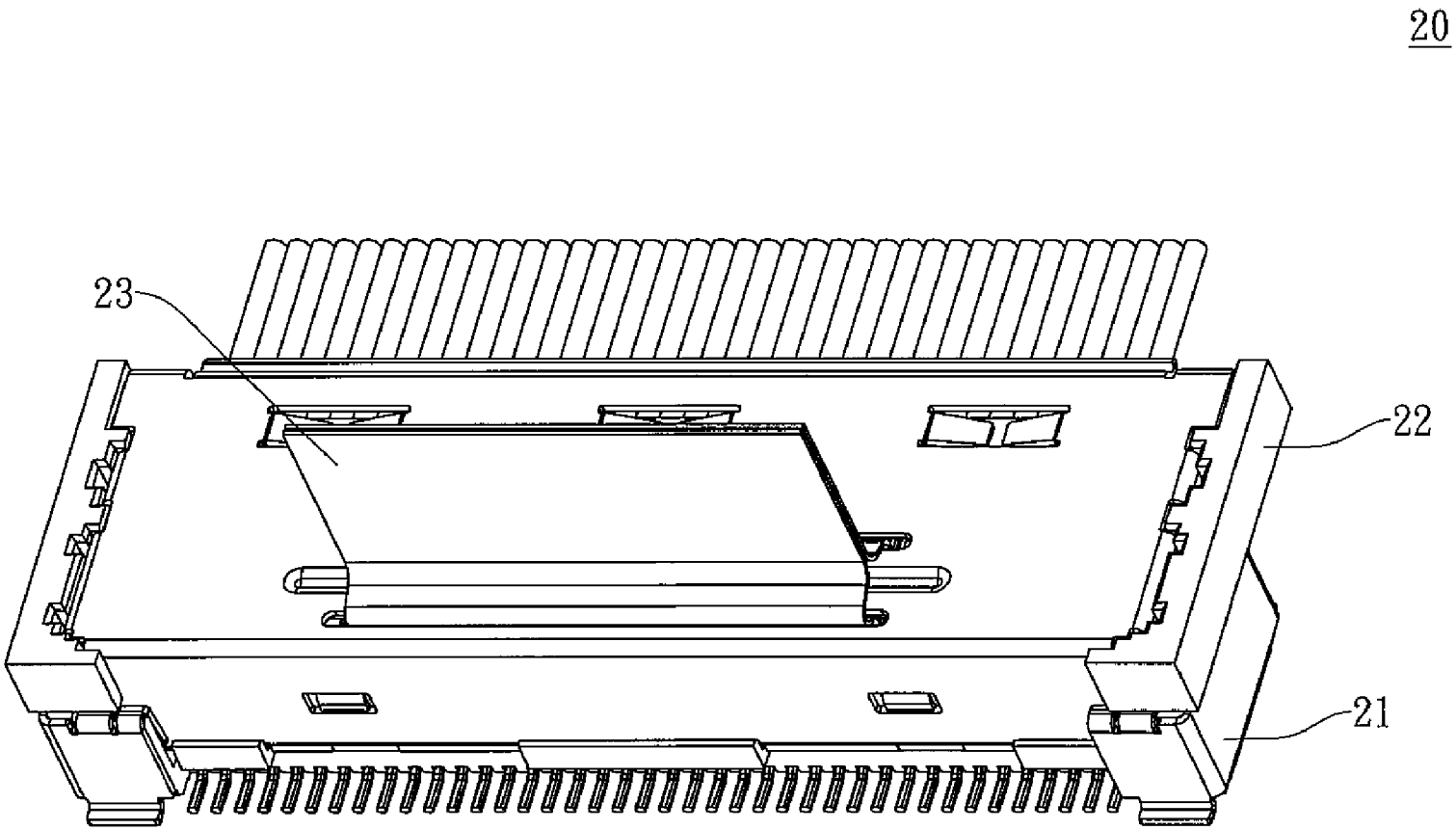
FIG. 4 is a block diagram of a prior art electrical connector.

In the embodiment shown in FIG. 3A, the fastener 7 is moved along the sliding slot 13 in the direction indicated by the arrow (i.e. a leftward direction). Referring to FIG. 3D, the fastener 7 is positioned and biased to the left side of the electrical connector assembly 1. In the embodiment shown in FIG. 3D, the second receiving piece 10 at the left side of the upper portion of the fastener 7 receives the second projection 12 at the left side of the top of the second latch 6, while the first receiving piece 9 at the left side of the lower portion of the fastener 7 receives the first projection 11 along the left side of the bottom of the first latch 4. Accordingly, the fastener 7 is shown in a "fastened position".

In the embodiment shown, when the plug 5 is inserted into the socket 2, the fastener 7 can be moved along the sliding slot 13 in a leftward direction (i.e. a direction toward the first latch 4) to the fastened position, thereby fastening together the plug 5 and the socket 2. Furthermore, in the embodiment shown, when the fastener 7 is moved along the sliding slot 13 in a rightward direction (i.e. a direction away from the first latch 4) to the "unfastened position", the plug 5 can be detached from the socket 2 by pulling the pulling mechanism 8.

An advantage of the present invention is that the plug 5 and the socket 2 can be fastened together or unfastened for separation by moving the fastener 7 alongside the first and second latches 4 and 6.

While the invention has been described in terms of what are presently considered to be the most practical and preferred embodiments, it should be understood that the invention is not limited thereto. Various alterations and modifications may be made by the skilled person in the art without departing from the spirit and scope of the present invention.

What is claimed is:

1. An electrical connector assembly, comprising:
- a socket having a slot and a first latch disposed at one side of the slot;
- a plug having a second latch and inserted into the slot of the socket;
- a sliding slot being disposed on top of the second latch of the plug along which a fastener is moved corresponding to the first latch of the socket; and
- the fastener disposed on the second latch of the plug, the fastener connects the first and second latches to fasten or unfasten the plug and the socket.

2. The electrical connector assembly according to claim 1, further comprising a pulling mechanism.

3. The electrical connector assembly according to claim 2, wherein the plug can be detached from the socket by pulling the pulling mechanism.

4. The electrical connector assembly according to claim 1, wherein the fastener 7 includes a symbol to indicate that the socket and the plug can be fastened together by moving the fastener in a direction shown by the symbol.

5. The electrical connector assembly according to claim 1, further comprising a first receiving piece positioned on the fastener.

6. The electrical connector assembly according to claim 5, further comprising a second receiving piece positioned on the fastener.

7. The electrical connector assembly according to claim 5, further comprising a first projection positioned on the first latch.

8. The electrical connector assembly according to claim 6, further comprising a first projection positioned on the first latch.

9. The electrical connector assembly according to claim 7, further comprising a second projection positioned on the top or bottom of the second latch.

10. The electrical connector assembly according to claim 6, further comprising two second projections.

11. The electrical connector assembly according to claim 9, wherein one second projection is positioned on top of the second latch, while one second projection is positioned on the bottom of the second latch.

12. The electrical connector assembly according to claim 8, wherein the plug and socket fasten when the second receiving piece receives the second projection and the first receiving piece receives the first projection.

13. The electrical connector assembly according to claim 10, wherein the plug and socket unfasten when the second receiving piece receives the second projection on the top of the second latch.

14. The electrical connector assembly according to claim 12, further comprising an additional second receiving piece positioned on a lower portion of the fastener.

15. The electrical connector assembly according to claim 13, wherein the plug and socket unfasten when the additional second receiving piece receives the second projection on the bottom of the second latch.

16. The electrical connector assembly according to claim 1, wherein the fastener moves along the sliding slot in a direction toward the first latch to fasten the plug and the socket.

17. The electrical connector assembly according to claim 1, wherein the fastener moves along the sliding slot in a direction away from the first latch to unfasten the plug and the socket.

18. An electrical connector assembly, comprising:
- a socket having a slot and a first latch disposed at one side of the slot;
- a plug having a second latch and inserted into the slot of the socket;
- a sliding slot being disposed on the second latch corresponding to the first latch of the socket;
- a fastener disposed on the second latch of the plug, the fastener connects the first and second latches to fasten or unfasten the plug and the socket;
- a first receiving piece positioned on the fastener;
- a first projection positioned on the first latch; and
- a second projection positioned on the top or bottom of the second latch;
- wherein one second projection is positioned on top of the second latch, while one second projection is positioned on the bottom of the second latch.

19. The electrical connector assembly according to claim 18, wherein the plug and socket fasten when a second receiving piece receives the second projection and the first receiving piece receives the first projection.

20. The electrical connector assembly according to claim 19, wherein the plug and socket unfasten when the second receiving piece receives the second projection on the top of the second latch.

21. The electrical connector assembly according to claim 20, further comprising an additional second receiving piece positioned on a lower portion of the fastener.

22. The electrical connector assembly according to claim 21, wherein the plug and socket unfasten when the additional second receiving piece receives the second projection on the bottom of the second latch.

* * * * *